US010800504B2

(12) United States Patent
Arvidsson et al.

(10) Patent No.: US 10,800,504 B2
(45) Date of Patent: Oct. 13, 2020

(54) PROPELLER DRIVE ASSEMBLY

(71) Applicant: AB VOLVO PENTA, Gothenburg (SE)

(72) Inventors: Lennart Arvidsson, Kållered (SE); Lars Larsson, Alingsås (SE)

(73) Assignee: AB VOLVO PENTA, Gothenburg (SE)

( * ) Notice: Subject to any disclaimer, the term of this patent is extended or adjusted under 35 U.S.C. 154(b) by 247 days.

(21) Appl. No.: 15/774,301

(22) PCT Filed: Dec. 2, 2015

(86) PCT No.: PCT/SE2015/051292
§ 371 (c)(1),
(2) Date: May 8, 2018

(87) PCT Pub. No.: WO2017/095280
PCT Pub. Date: Jun. 8, 2017

(65) Prior Publication Data

US 2020/0086962 A1 Mar. 19, 2020

(51) Int. Cl.

| | |
|---|---|
| ***B63B 21/38*** | (2006.01) |
| ***B63H 21/38*** | (2006.01) |
| ***B63H 23/32*** | (2006.01) |

(52) U.S. Cl.
CPC ..... *B63H 21/386* (2013.01); *B63H 23/321* (2013.01); *B63H 2023/327* (2013.01)

(58) Field of Classification Search
CPC ..... B63H 21/386; B63H 23/321; B63H 2023/327; B63H 21/38
See application file for complete search history.

(56) References Cited

U.S. PATENT DOCUMENTS

| | | | |
|---|---|---|---|
| 2,987,031 | A | 6/1961 | Odden |
| 4,413,829 | A | 11/1983 | Pietsch |
| 5,374,208 | A | 12/1994 | Von Bergen et al. |

(Continued)

FOREIGN PATENT DOCUMENTS

| | | | |
|---|---|---|---|
| CN | 1087592 | A | 6/1994 |
| CN | 101925510 | A | 12/2010 |

(Continued)

OTHER PUBLICATIONS

International Search Report (dated Aug. 29, 2016) for corresponding International App. PCT/SE2015/051292.

(Continued)

*Primary Examiner* — Stephen P Avila
(74) *Attorney, Agent, or Firm* — Venable LLP; Jeffri A. Kaminski

(57) ABSTRACT

A propeller drive assembly for transferring a torque between an engine and at least one propeller of a water surface vessel includes a plurality of lubrication clients. The propeller drive assembly includes a first lubrication system arranged to house a first lubricant, dedicated for lubrication of at least one first of the lubrication clients, and a second lubrication system arranged to house a second lubricant, dedicated for lubrication of at least one second of the lubrication clients, the at least one second lubrication client includes a seal arranged to seal the second lubrication system from a body of water surrounding at least a portion of the propeller drive assembly, the second lubrication system being arranged to transport the second lubricant to the seal.

20 Claims, 4 Drawing Sheets

(56) References Cited

U.S. PATENT DOCUMENTS

| | | | | |
|---|---|---|---|---|
| 5,697,821 | A | 12/1997 | Ogino | |
| 5,791,951 | A | 8/1998 | Staerzl | |
| 2011/0021095 | A1 | 1/2011 | Shuto et al. | |
| 2015/0098824 | A1* | 4/2015 | Oh | B63H 5/10 416/170 R |

FOREIGN PATENT DOCUMENTS

| | | | |
|---|---|---|---|
| JP | S52153300 | U | 11/1977 |
| JP | 3716458 | B2 | 11/2005 |
| WO | 2009130368 | A1 | 10/2009 |
| WO | 2015159931 | A1 | 10/2015 |

OTHER PUBLICATIONS

Official Action (dated May 31, 2019) for corresponding European App. 15909879.7.
Notice of Reasons for Rejection issued in corresponding Japanese Patent Application No. 2018-525571, dated Nov. 5, 2019.
Chinese Office Action issued in corresponding Chinese Patent Application No. 201580084782.4, dated Oct. 31, 2019.

* cited by examiner

PROPELLER DRIVE ASSEMBLY

BACKGROUND AND SUMMARY

The invention relates to a propeller drive assembly for transferring a torque between an engine and at least one propeller of a water surface vessel.

For water surface vessels with engine propulsion, it is desirable from an environmental aspect to keep emissions of environmentally harmful lubricants to a minimum.

In propeller drive assemblies, such as stem drives or pod drives, for transferring a torque between an engine and at least one propeller of a water surface vessel, such as a power boat, there are pans, such as bearings and seals, requiting lubrication. Such lubrication is usually provided by a lubrication system. Also, one or more seals may be provided for separating a lubricant of the lubrication system from a body of water surrounding the propeller drive assembly.

It is known to provide grease lubrication for such separating seals. The grease may be provided between the seal serving as a water barrier or a lubricating compound. A problem with such grease lubrication is that with time the grease gradually disappears, and as a result the seal may start wearing on the propeller shaft. If the propeller shaft is made in a material which has a relatively low resistance to wear, such as stainless steel, a direct contact of a seal to the propeller shaft may result in the seal locally wearing down the shaft, and or the seal being worn down. Such a wear may cause leakage of lubricant into the water, which works counter to the desire to keep emissions of environmentally harmful lubricants to a minimum. Also, detrimental leakage of water into the propeller drive assembly may occur.

It is desirable to provide a propeller drive assembly for a water surface vessel which minimises emissions of environmentally harmful lubricants.

In accordance with an aspect of the invention, a propeller drive assembly for transferring a torque between an engine and at least one propeller of a water surface vessel is provided, the propeller drive assembly comprising a plurality of lubrication clients, characterized in that the propeller drive assembly comprises a first lubrication system arranged to house a first lubricant, dedicated for lubrication of at least one first of the lubrication clients, and a second lubrication system arranged to house a second lubricant, dedicated for lubrication of at least one second of the lubrication clients, the at least one second lubrication client comprising a seal arranged to seal the second lubrication system from a body of water surrounding at least a portion of the propeller drive assembly, the second lubrication system being arranged to transport the second lubricant to the seal.

The first and second lubricants may be in a liquid form, i.e. not in a solid or a semi-solid form such as grease, in a normal operational temperature range, e.g. 0-70° C., of the propeller drive assembly.

The first lubrication system may be arranged to transport the first lubricant to the first lubrication client. The second lubrication system may be arranged to transport the second lubricant to the second lubrication client. The first lubrication system being dedicated for lubrication of the first lubrication client(s), and the second lubrication system being dedicated for lubrication of the second lubrication client(s), means that the first lubrication system is not arranged to lubricate the second lubrication client(s) and the second lubrication system is not arranged to lubricate the first lubrication client(s). I.e., the first and second lubrication systems are arranged so that the first and second lubricants are kept separate.

The transport by the second lubrication system of the second lubricant to the seal provides for a lubricating film at the seals to be renewed to avoid wear, increasing the lifetime of the seal, which reduces the risk of leakage of lubricant to the surrounding water. Also, the separation of the first and second lubricants provided by the invention allows for providing different types of lubricants, adapted to the different locations and tasks of the first and second lubrication clients.

In particular, in view of die second lubrication clients) comprising the seal arranged to seal the second lubrication system the surrounding water surrounding, with an associated risk of minor leakage of lubricant into the water, the second lubricant may be provided as a particularly environmentally friendly lubricant, such as a biodegradable oil. Meanwhile, the first lubrication system, which may serve a considerably higher number of lubrication clients, such as bearings and further seals, than the second lubrication system, may provide the first lubricant as an effective traditional transmission oil, e.g. a fully synthetic transmission oil. The second lubrication system may thus provide a barrier between the water and the environmentally less friendly traditional transmission oil.

Preferably, the second lubrication system presents a feeding cavity for the second lubricant, the second lubrication system being arranged to transport the second lubricant from the feeding cavity to the seal. The feeding cavity may serve as a storage space or a buffer for tire second lubricant distribution.

Preferably, where the propeller drive assembly presents a propeller shaft supporting a propeller at a first end of the propeller shaft, the feeding cavity is located at a second end of the propeller shaft, which second end is opposite to the first end. It is understood that the propeller drive assembly may further comprise a housing, enclosing e.g. the first lubrication client, and other parts of the propeller drive assembly. Thus, the feeding cavity may be provided at a propeller shaft end which is opposite to the end at which the propeller is mounted, allowing the housing to provide a generous amount of space for tire feeding cavity.

The seal may be of any suitable type. In some embodiments, the seal is a V ring seal. Such a seal may be adapted to receive a lubricant film between a lip of the seal and a propeller shaft around which the seal extends. In other embodiments, the seal is a mechanical seal, e.g. with two ceramic flanges, axially biased, e.g. by spring force, towards each other, and adapted to be provided with a lubricant film between the ceramic flanges.

Preferably, where the propeller drive assembly comprises a propeller shaft for supporting a propeller, the second lubrication system presents a bore in the propeller shaft for the transport of the second lubricant. It is understood that opposite ends of the bore provide a communication between separate portions of the propeller shaft exterior. The bore may provide an advantageous means of transport of the second lubricant along the propeller shaft. For example, the bore may be arranged to transport the second lubricant internally in the propeller shaft past a region in the propeller drive assembly where the propeller shaft is in external contact with the first lubricant. Such a region may present a driveshaft extending in a non-zero angle to the propeller shaft, and engaging the propeller shaft via a gear set served by the first lubricant, as exemplified below Thereby, the separation of the first and second lubricants is secured.

The bore may be of any suitable shape, with any suitable location. In preferred embodiments at least a portion of the bore is a straight conduit, extending in parallel with the propeller shaft. The conduit is preferably coaxial with the propeller shaft. The bore may present at least a portion extending in a non-zero angle to the longitudinal direction of the propeller shaft. For example, such a portion may extend radially from a bore portion which is parallel with the propeller shaft. Thereby, a bore portion which is parallel with the propeller shaft may be arranged to transport the second lubricant from an end of the propeller shaft which is opposite to an end thereof carrying the propeller, to a position between said ends, and the radial bore portion may provide a communication between the shaft parallel bore portion at said position and the exterior of the propeller shaft.

Providing at least a portion of the bore so as to extend in a non-zero angle, e.g. radially, to the propeller shaft, may assist the transport of the second lubricant to the seal. Tire reason is that the non-zero angle may allow a centrifugal force provided by the propeller shaft rotation to act upon, and move the second lubricant along the bore. For example, a bore portion extending in a non-zero angle to, and communicating with, a bore portion being parallel with the longitudinal direction of the propeller shaft, may allow the centrifugal force to act on the second lubricant in the former bore portion, to move the second lubricant along the former bore portion, to thereby assist in the transport of the second lubricant to the seal.

The seal may be provided between the propeller shaft and a further part of the propeller drive assembly, wherein the bore is arranged for the transport of the second lubricant towards the seal. The second lubrication system is preferably arranged to transport the second lubricant to the seal at least partly by the force of gravity. Preferably, second lubrication system comprises a storage reservoir arranged to communicate with the bore, and adapted to be located, e.g. in use, above the bore. The storage reservoir may be integrated with, or arranged to communicate with said feeding cavity. The storage reservoir secures renewal of the lubrication film at the seal, and other second lubricant consuming processes during a substantial time period. The location of the storage reservoir above the bore provides for a gravity feed of the second lubricant from the storage reservoir to the bore. The second lubricant may Anther be fed through the bore and onwards towards said seal, by the pressure created the force of gravity. In addition, the storage reservoir may be located so that it is easily accessible for a person servicing the propeller drive assembly, allowing such a person to refill second lubricant into the storage reservoir when needed. It is understood that the second lubrication system preferably includes a communication with the atmosphere to allow air to enter to replace second lubricant which has been "consumed" by the second lubrication client(s). Where a storage reservoir is provided as described above, such an atmosphere communication may be provided in by the storage container.

The second lubrication system may comprise an Archimedes screw for urging the second lubricant through the bore. Thus, the Archimedes screw provides an advantageous, simple and cost effective means for assisting in the transport of the second lubricant along the propeller shaft towards the seal. In some embodiments, the Archimedes screw is fixed to the propeller shaft. Thereby, the second lubricant transport may be effected simply with the energy provided by the propeller shaft rotation, and no additional source of energy needs to be provided. Preferably, the Archimedes screw is located in the bore. This provides an advantageous integration of the Archimedes screw and the bore for assisting the transportation of the second lubricant. In some embodiments, the Archimedes screw is fixed to a fixed part of the propeller drive assembly. The screw may thereby be is located in the bore, whereby the propeller shaft rotation may cause the second lubricant to rotate, and thereby be transported through the bore by the fixed screw.

A variety of additional or alternative means for assisting the transport of the second lubricant to the seal may be provided. Such means may include any one, or a combination of a mechanical pump, an electrically driven pump, a hydraulically driven pump and a pneumatically driven pump.

Preferably, where the propeller drive assembly comprises a propeller shaft, the propeller drive assembly comprises at least one seal which surrounds the propeller shaft and is arranged to separate the first and second lubricants. The propeller shaft, which may be supported by at least a first bearing arranged to be lubricated by the first lubrication system, and a second bearing arranged to be lubricated by the second lubrication system. Thereby, the second bearing may be located in the vicinity of the seal arranged to seal the second lubrication system from the surrounding water.

The propeller drive assembly may the provided with two propellers, which are counter-rotating. The propeller drive assembly may comprise a first propeller shaft for supporting a first propeller, and a second propeller shaft for supporting a second propeller, the second propeller shaft being tubular and coaxial with the first propeller shaft, the first propeller shaft being arranged at least partly inside the second propeller shaft. Preferably, the second lubrication system presents a gap between the first and second propeller shafts for the transport of the second lubricant. The seal may be provided between the first propeller shaft and a further part of the propeller drive assembly such as the second propeller shaft, or between the second propeller shaft and a farther part of the propeller drive assembly such as a housing of the propeller drive assembly, wherein the gap is arranged for the transport of the second lubricant towards the seal.

The gap between the first and second propeller shafts provides an advantageous means for the lubricant transport, e.g. where the seal is provided between the first and second propeller shafts, as exemplified below. The gap may communicate with a bore in the first propeller shaft, as also exemplified below, so that the transport along a part of the distance between a feeding cavity and the seal is provided by the bore in tire first propeller shaft, and the transport along a farther part of the distance between the feeding cavity and the seal is provided by the grip between the first and second propeller shafts.

Where the seal is provided between the second propeller shaft and a fixed part of the propeller drive assembly, located externally of the second propeller shaft such as the housing, a radially extending hole in the second propeller shaft may be arranged to guide the second lubricant from the gap towards the seal.

The propeller drive assembly may be e.g. a stem drive or a pod drive. More generally, the propeller drive assembly may comprise a propeller shaft and a driveshaft extending in a non-zero angle to the propeller shaft and engaging with the propeller shaft via a bevelled gear set. Such a propeller and driveshaft combination is suitable where the vessel is a power boat, and the invention is particularly advantageous on powerboats which may travel in inland waters with a particularly high environmental sensitivity.

As mentioned, the propeller drive assembly may comprise a first propeller shaft for supporting a first propeller, and a second propeller shaft for supporting a second propeller, the second propeller shaft being tubular and coaxial with the first propeller shaft, the first propeller shaft being arranged at least partly inside the second propeller shaft. Also, the propeller drive assembly may comprise a driveshaft extending in a non-zero angle to the first and second propeller shafts, and being arranged to drive the first and second propeller shafts. Preferably, the driveshaft meshes on a first side of the driveshaft with a first bevelled gear fixer to the first propeller shaft, and meshes on a second side of the driveshaft, opposite to the first side, with a second bevelled gear fixed to the second propeller shaft. Thereby, the second lubrication system preferably presents a bore in the first propeller shaft for the transport of the second lubricant from a first side of the driveshaft in a direction towards a second side of the driveshaft, opposite to the first side, said seal being located on said second side of the driveshaft.

Thereby, a feeding cavity for the second lubricant may be advantageously provided on the first side of the driveshaft, where sufficient space for the cavity may be easily provided. Also, the second lubricant may be transported from the feeding cavity, internally in the first propeller shaft, past the drive shaft. Thereby, engagements, e.g. involving said bevelled gears, between the driveshaft and the propeller shafts may be served by the first lubricant, while the second lubricant may be transported past said engagements while being kept separate from the first lubricant.

Similarly to what has been discussed above, the second lubrication system may present a gap between the first and second propeller shafts for transport of the second lubricant from said bore, on said second side of the driveshaft, in a direction away from the driveshaft, Preferably, a first seal is arranged to separate the first and second lubricants, and is provided on said first side of the driveshaft, between the first propeller shaft and a surrounding fixed part of the propeller drive assembly. Preferably, a second seal is arranged to separate the first and second lubricants, and is provided on said second side of the driveshaft, between the first and second propeller shafts. Preferably, a third seal is arranged to separate the first and second lubricants, and is provided on said second side of the driveshaft, between the second propeller shaft and a surrounding fixed part of the propeller drive assembly. Said second lubrication client, to which the second lubricant s arranged to transport the second lubricant, may be provided on said second side of the driveshaft. Such an arrangement of seals separating the first and second lubricants, assists in the serving of the bevelled gears of the driveshaft and the propeller shafts by an effective lubricant of the first lubrication system, while a feeding cavity for an environmentally friendly second lubricant may be provided on one side of the driveshaft and the second lubrication client served by the second lubrication system may be provided on an opposite side of the driveshaft.

The seal arranged to seal the second lubrication system from the body of water, may be provided between the first and second propeller shafts. The said seal arranged to seal the second lubrication system from the body of water, may also be provided between the second propeller shaft and a surrounding fixed pan of the propeller drive assembly. It is understood that, in particular in a double propeller shaft arrangement as described above, there may advantageously be two seals arranged to seal the second lubrication system from the water, one of which is provided between the first and second propeller shafts and the other of which is provided between the second propeller shaft and the surrounding fixed part of the propeller drive assembly.

A water surface vessel, comprising a propeller drive assembly according to any claim herein, or any embodiment described herein, is also provided.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples. In the drawings.

DETAILED DESCRIPTION

Figure 1:
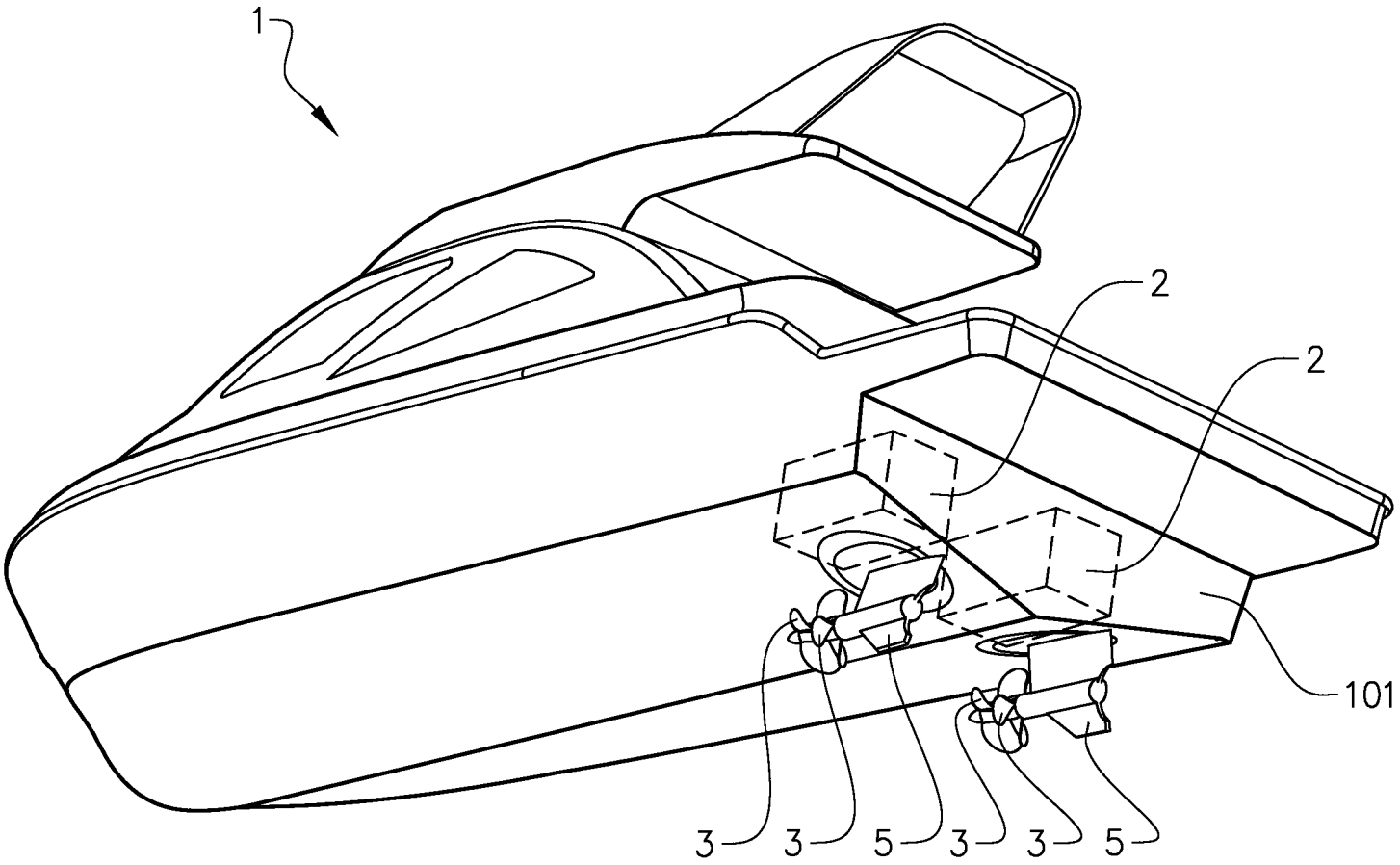
FIG. 1 is perspective view from below of a water surface vessel provided with two propeller drive assemblies according to an embodiment of the invention.

FIG. 1 shows a water surface vessel in the form of a power boat with two engines 2, indicated with broken lines. Each engine 2 is adapted to drive a set of coaxially arranged counter-rotating propellers 3 which face forward in the forward travel direction of the vessel 1. The propeller sets are provided on a respective propeller drive assembly 5 in the form of a pod drive 5. The pod drives 5 are located side by side on a bottom side of the vessel, in the vicinity of a stem 101 thereof. The pod drives 5 are distributed in a horizontal, lateral direction of the vessel 1. It is understood that each propeller drive assembly 5 is arranged to transfer a torque between the respective engine 2 and the respective set of propellers 3.

It should be noted that the invention is applicable to a variety of vessel types, and to a variety of propeller drive assemblies. For example, the propeller drive assemblies 5 may be provided in the form of sterndrives 5, located side by side on the stem 101. In further embodiments, a single, or more than two propeller drive assemblies may be provided.

Figure 2:
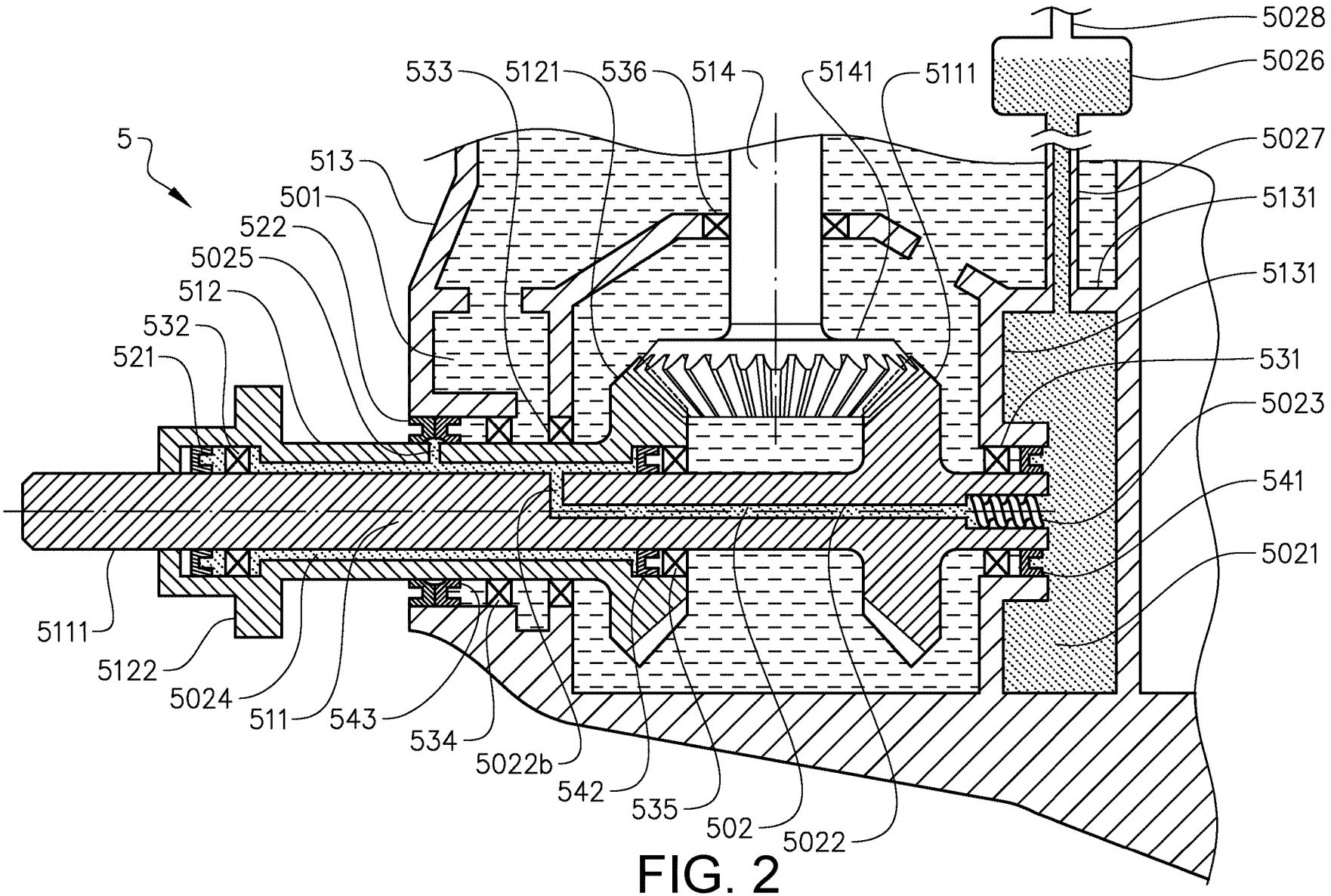
FIG. 2 is a cross sectional view of a portion of one of the propeller drive assemblies of the vessel in FIG. 1, the section being oriented along the rotational axis of the propellers thereof, and along a driveshaft of the assembly.

Reference is made to FIG. 2, showing a cross section of a portion of one of the propeller drive assemblies. The propeller drive assembly comprises a housing 513 supporting various pans as described below. The propeller drive assembly further comprises a two propeller shafts 511, 512 protruding from the housing. A first 511 of the propeller shafts is provided for supporting a first of the propellers 3 in the propeller set. The first propeller, which is not shown in FIG. 2, is mounted to a distal end of the first propeller shaft 511. In FIG. 2 the distal end is shown as an end protruding in the left part of the figure.

A second 512 of the propeller shafts is provided for supporting a second of the propellers 3 in the propeller set. The second propeller shaft 512 is tubular and coaxial with the first propeller shaft 511, and the first propeller shaft 511 is arranged partly inside the second propeller shaft 512. The second propeller, which is not shown in FIG. 2, is mounted behind the first propeller in the forward travel direction of the vessel 1. More specifically, the second propeller is mounted between a flange 5122 at a distal end of the second propeller shaft 512, and the housing 513.

The propeller drive assembly further comprises a driveshaft 514 extending substantially perpendicularly to the first and second propeller shafts 511, 512. The driveshaft 514 extends from the first and second propeller shafts 511, 512, which are located in a lower portion of the propeller drive assembly 5, upwards, and is arranged to deliver the torque from the respective engine 2.

The driveshaft 514 is engaged with the propeller shafts 511, 512 via bevelled gear sets. More specifically, the driveshaft 514 comprises at its lower end a bevelled gear 5141. On a first side of the driveshaft 514, which first side in FIG. 2 is to the right of the driveshaft 514, i.e. opposite to the forward travel direction of the vessel 1, the bevelled gear 5141 of the driveshaft meshes with a bevelled gear 5111, herein also referred to as a first bevelled gear, fixed to the first propeller shaft 511. On a second side of the driveshaft 514, which second side in FIG. 2 is to the left of the driveshaft 514, i.e. in the forward travel direction of the vessel 1, the bevelled gear 5141 of the driveshaft meshes with a bevelled gear 5121, herein also referred to as a second bevelled gear, fixed to the second propeller shaft 512. This provides for the propellers on the first and second propeller shafts 511, 512 to be counter-rotating.

The first propeller shaft 511 is supported by a first bearing 531 and a second bearing 532. The first bearing 531 is provided on the first side of the driveshaft 514, and supports the first propeller shaft against the housing 513. The second bearing 532 is provided on the second side of the driveshaft 514, and supports the first propeller shaft 511 against the second propeller shaft 512. A third bearing 533 and a fourth bearing 534 support the second propeller shaft 512 against the housing 513. A fifth bearing 535 supports the second propeller shaft 512 against the first propeller shaft 511. The fifth bearing 535 is located on the second side of the driveshaft. The third bearing 533 and the fourth bearing 534 are located between the second bearing 532 and the fifth bearing 535. A sixth bearing 536 supports the driveshaft 514 against the housing 513.

The bearings 531-536 and number of seals, described below, form what is herein referred to as lubrication clients served by two lubrication systems. A first lubrication system 501 is arranged to house a first lubricant in a liquid form. The first lubricant is in this embodiment a traditional transmission oil. The first lubrication system 501 is dedicated for providing lubrication for what is herein referred to as first lubrication clients. The first lubrication clients include the first bearing 531, the third bearing 553, the fourth bearing 534, the fifth bearing 535 and the sixth bearing 536. The first lubrication system 501 is arranged to transport the first lubricant to the first lubrication clients 531, 533, 534, 535, 536.

A second lubrication system 502 is arranged to house a second lubricant in a liquid form. The second lubricant is in this embodiment a biodegradable oil. The second lubrication system 502 is dedicated for providing lubrication for what is herein referred to as second lubrication clients which include the second bearing 532.

The first and second lubricants are separated from each other and from the surrounding water by parts of the propeller drive assembly 5 including seals and the housing 513 with a plurality of walls 5131. A first seal 541, arranged to separate the first and second lubricants, is provided on the first side of the driveshaft 514, between the first propeller shaft 511 and the housing 513. A second seal 542, also arranged n separate the first and second lubricants, is provided on the second side of the driveshaft 514, between the first and second propeller shafts 511, 512. A third seal 543, also arranged to separate the first and second lubricants, is provided on the second side of the driveshaft 514, between the second propeller shaft 512 and the housing 513.

A fourth seal 521 is arranged to separate the second lubricant from the water surrounding the propeller drive assembly, and is provided on the second side of the driveshaft 514, at the distal and of the second propeller shaft 512, and between the first and second propeller shafts 511, 512. A fifth seal 522 is also arranged to separate the second lubricant from the water, and is provided on the second side of the driveshaft 514, between the second propeller shaft 512 and the housing 513. The fourth seal 521 and the fifth seal 522 are arranged to be lubricated by the second lubrication system and are therefore herein referred to as second lubrication clients.

The second lubrication system 502 presents, on the first side of the driveshaft 514, a feeding cavity 5021 for the second lubricant. Thus the feeding cavity 5021 is located at an end of the first propeller shaft 511, which end is opposite to the distal end 5111 at which the first propeller shaft 511 carries one of the propellers 3 (FIG. 1).

The second lubrication system 502 further presents a bore 5022 in the first propeller shaft 511 for transport of the second lubricant from the feeding cavity 5021 in a direction towards the second side of the driveshaft 514. Tire bore 5022 presents a longitudinal portion which is coaxial with the first propeller shaft 511, and a lateral portion **5022*b*, or radial portion, on the second side of the driveshaft 514. The lateral portion 5022*b* leads from the longitudinal portion of the bore 5022 to a gap 5024 between the first and second propeller shafts 511, 512. The lateral portion 5022*b* allows the centrifugal force caused by the first propeller shaft rotation to act on the second lubricant in the lateral portion 5022*b*, to move the second lubricant along the lateral portion 5022*b*; to thereby assist in the transport of the second lubricant to the fourth and fifth seals 521, 522**.

Thus, the longitudinal bore portion is arranged to transport die second lubricant from the propeller shaft end at the feeding cavity 5021, to a position between the shaft ends, and the radial bore portion **5022*b* provides a communication between the longitudinal bore portion at said position and the exterior of the first propeller shaft 511. The gap 5024 is arranged guide the second lubricant from the bore 5022, on the second side of the driveshaft 514, towards the distal end of the second propeller shaft 512**.

Thus, the bore 5022 and the gap 5024 are arranged to guide the second lubricant from the feeding cavity 5021 to the second beating 532 and the fourth seal 521. Also, a lateral, i.e. radially extending hole 5025 in the second propeller shaft 512 is arranged to guide the second lubricant from the gap 502-1 to the fifth seal 522.

Thus, the second lubrication system 502 is arranged to transport the second lubricant from the feeding cavity 5021 to the second lubrication clients including the second bearing 532 and the fourth and fifth seals 521,522.

The second lubrication system 502 further comprises a storage reservoir 5026 arranged to communicate with the bore 5022 via the feeding cavity 5021. The storage cavity is located above the feeding cavity 5021 and the bore 5022. A feeding conduit 5027 extends between the storage reservoir 5026 and the feeding cavity 5021. This provides a gravity feed of the second lubricant from the storage reservoir 5026 to tire bore 5022. The second lubricant is fed further through the bore 5022 and onwards towards the fourth and fifth seals 521, 522 via the gap 5024, by the pressure created the force of gravity provided by the storage reservoir location. In addition, the storage reservoir is located so that it is easily accessible for a person servicing the propeller drive assembly, allowing such a person to refill second lubricant into the storage reservoir 5026 when needed. The storage reservoir 5026 presents a ventilation opening 5028 providing a communication with the atmosphere to allow air to enter to replace second lubricant which has been "consumed" by the second lubrication clients.

It should be noted that in some embodiments, the feeding cavity 5021 may provide the entire storage function of the second lubrication system, and it may thereby be provided with a ventilation opening ensuring a communication with the atmosphere to allow air to enter to replace consumed second lubricant. In such embodiments the feeding cavity 5021 may thus also be what is herein referred to as a storage reservoir 5026. In other embodiments, the feeding conduit 5027 may extend to a fixed portion surrounding the propeller shaft 511, so that the conduit extends all the way to the bore 5022. In such embodiments, a lower pan of the feeding conduit 5027, in the vicinity of the bore 5022, may be regarded as what is herein referred to as a feeding cavity 5021.

Figure 3:
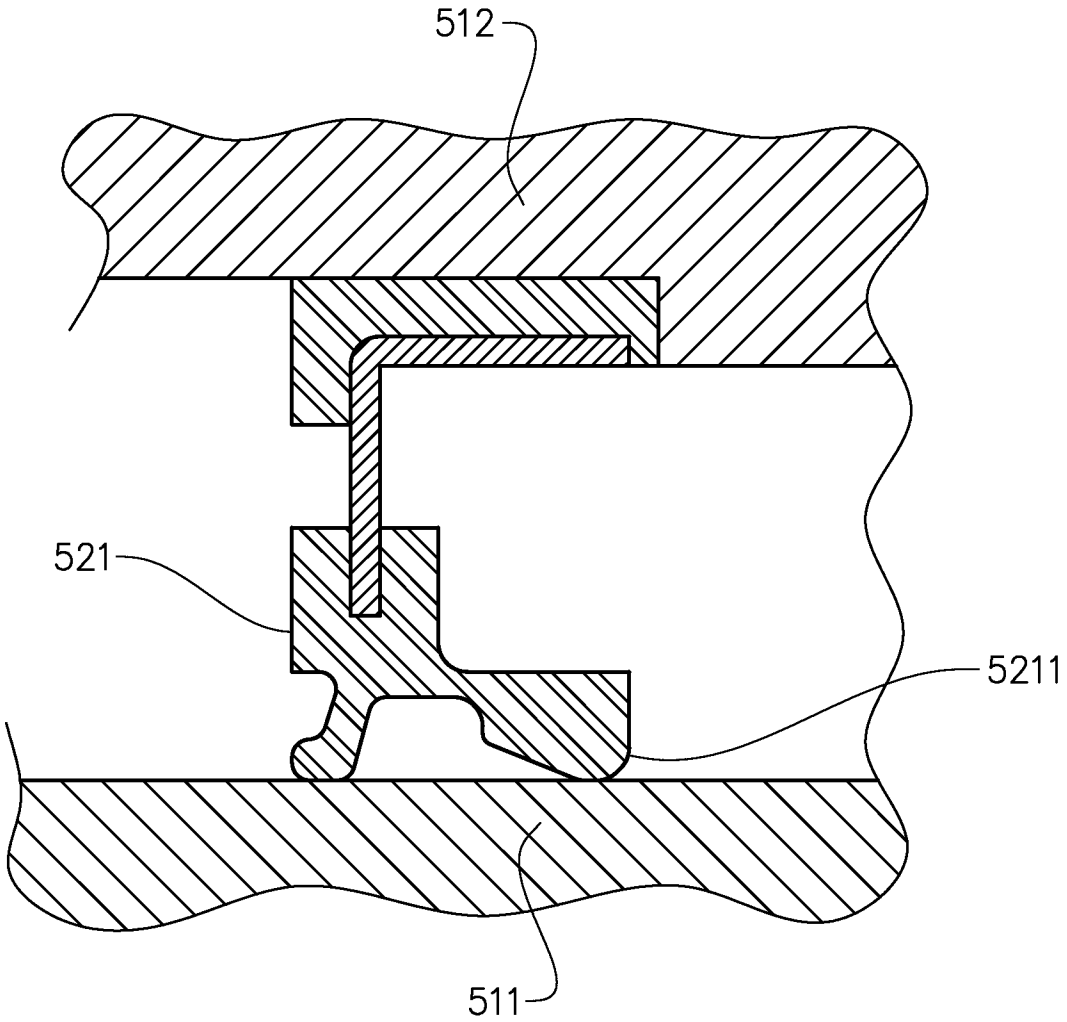
FIG. 3 is a detail of the view in FIG. 2.

For further assisting in the transportation of the second lubricant, the second lubrication system comprises an Archimedes screw 5023 for urging the second lubricant through the bore 5022. The screw 5023 is located in a widened end of the bore 5022 at the feeding cavity 5021, and it is fixed to the first propeller shaft 511. In some embodiments, no such Archimedes screw is provided, and the transport of the second lubricant is effected FIG. 3 shows an enlarged view of a part of the fourth seal 521 in this embodiment in FIG. 2. The other seals therein, including the fifth seal 522, may be of the same type. The fourth seal 521 is a V ring seal which is fixed to the second propeller shaft 512. The fourth seal 521 is arranged to extend around the first propeller shaft 511, and to rotate in relation to the first propeller shaft 511. The fourth seal 521 presents a U-shaped cross-section, and a lip 5211 which abuts the first propeller shaft 511.

The transport by the second lubrication system of the biodegradable oil to the fourth and fifth seals 521, 522 provides for a lubricating film at the seals to be renewed to avoid wear. Also, the biogradability of the second lubricant will minimise the environmental impact of any leakage of the lubricant into the water. The separation of the first and second lubricants provides for the first lubrication system, which may include considerably more lubrication clients than the second lubrication system, to provide an effective traditional transmission oil, e.g. a fully synthetic transmission oil. The second lubrication system may be seen as a barrier between the water and the environmentally less friendly traditional transmission oil.

Figure 4:
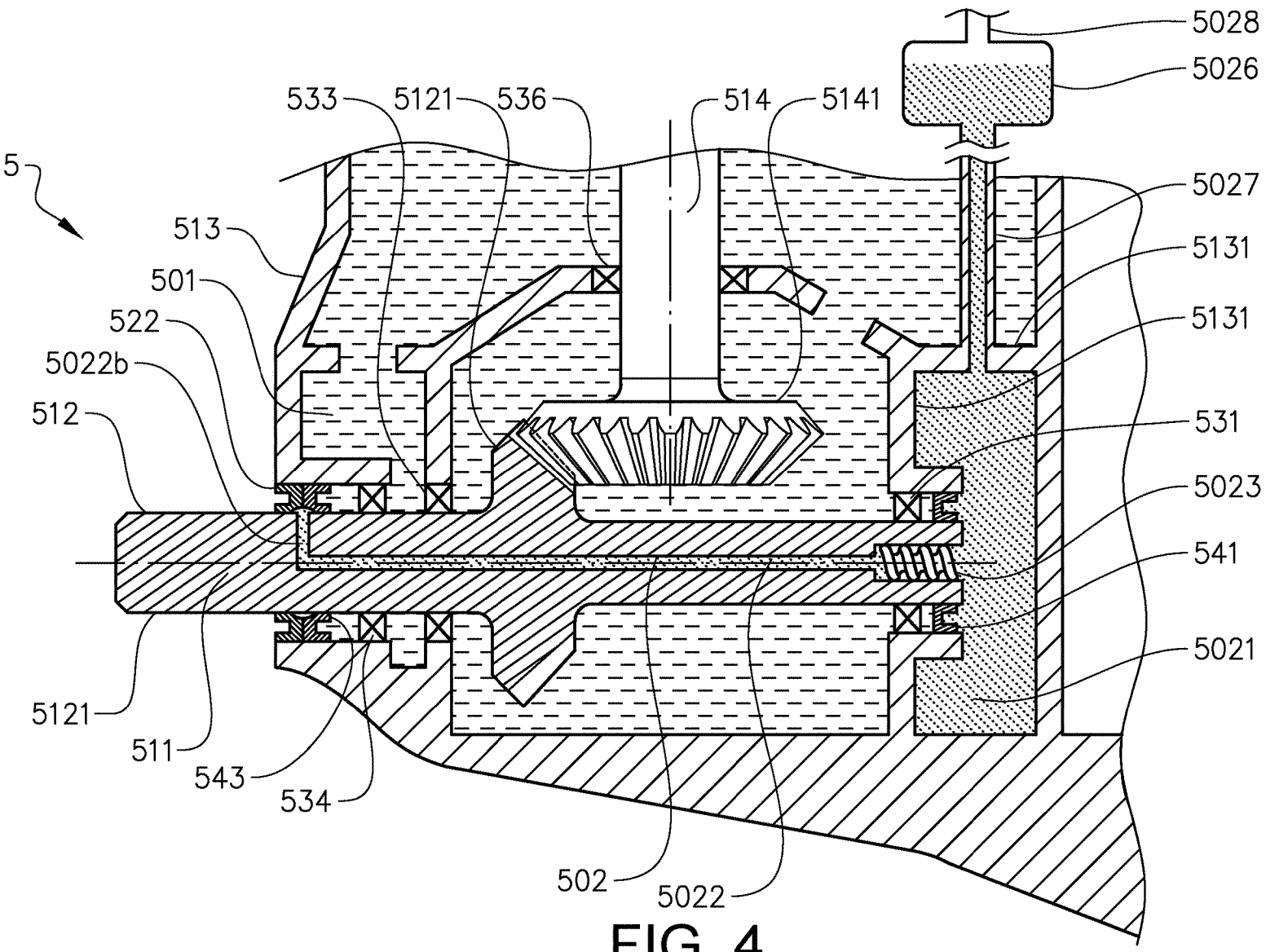
FIG. 4 is a cross sectional view of a portion of a propeller drive assembly according to an alternative embodiment of the invention.

FIG. 4 shows a cross section of a propeller drive assembly 5 according to an alternative embodiment of the invention. The propeller drive assembly 5 is arranged to drive a single propeller, (not shown). The propeller drive assembly comprises a housing 513 and a propeller shaft 512 protruding from the housing. The propeller shaft 512 is arranged to support, on a distal end 5121 thereof, a propeller. The propeller drive assembly further comprises a driveshaft 514 extending substantially perpendicularly to the propeller shaft 512. The driveshaft 514 comprises at its lower end a bevelled gear 5141, which meshes with a bevelled gear 5121 fixed to the propeller shaft 512.

The propeller shaft 511 is supported by bearings 531, 533, 534 against the housing 513. A further bearing 536 supports the driveshaft 514 against the housing 513.

The bearings 531, 533, 534 and number of seals, described below, form lubrication clients served by two lubrication systems. A first lubrication system 501 is arranged to house a first lubricant in a liquid form. The first lubrication system 501 is dedicated for providing lubrication for first lubrication clients including the bearings 531, 533, 534. A second lubrication system 502 is arranged to house a second lubricant in a liquid form. The first and second lubricants are separated from each other and from the surrounding water by parts of the propeller drive assembly 5 including the housing 513 with a plurality of walls 5131, and seals 541, 543 provided between the propeller shaft 512 and the housing 513.

The second lubrication system 502 is dedicated for providing lubrication for a second lubrication client in the form of a seal 522 arranged to separate the second lubricant from the water surrounding the propeller drive assembly 5. The seal 522 is provided between the propeller shaft 512 and the housing 513.

The second lubrication system 502 presents a feeding cavity 5021 for the second lubricant. The feeding cavity 5021 is located at an end of the propeller shaft 512, which end is opposite to the distal end 5121 at which the propeller shaft 512 carries the propeller. The second lubrication system 502 further presents a bore 5022 in the propeller shaft 512 for transport of the second lubricant from the feeding cavity 5021 in a direction towards the distal end 5121 of the propeller shaft 512. The bore 5022 presents a longitudinal portion which is coaxial with the propeller shaft 512, and a lateral portion 5022*b*. The lateral portion 5022*b* leads from the longitudinal portion of the bore 5022 to the seal 522.

Similarly to the embodiment described with reference to FIG. 2, for assisting in the transportation of the second lubricant from the feeding cavity 5021 towards the seal 522, the second lubrication system comprises a storage reservoir 5026 arranged to communicate with the bore 5022 via the feeding cavity 5021, and an Archimedes screw 5023 for urging the second lubricant through the bore 5022.

Again, the transport by the second lubrication system of the biodegradable oil to the seal 522 provides for a lubricating film at the seal to be renewed to avoid wear. Also, the biogradability of the second lubricant will minimise the environmental impact of any leakage of the lubricant into the water. The second lubrication system may be seen as a barrier between the water and an environmentally less friendly traditional transmission oil of the first lubrication system.

It is to be understood that the present invention is not limited to the embodiments described above and illustrated in the drawings; rather, the skilled person will recognize that many changes and modifications may be made within the scope of the appended claims.

The invention claimed is:

1. A propeller drive assembly for transferring a torque between an engine and at least one propeller of a water surface vessel, the propeller drive assembly comprising a propeller shaft for supporting a propeller and a plurality of lubrication clients, wherein the propeller drive assembly comprises a first lubrication system arranged to house a first lubricant, dedicated for lubrication of at least one first of the lubrication clients, and a second lubrication system arranged to house a second lubricant, dedicated for lubrication of at least one second of the lubrication clients, the at least one second lubrication client comprising a seal arranged to seal the second lubrication system from a body of water surrounding at least a portion of the propeller drive assembly, the second lubrication system presents a bore in the propeller shaft for transport of the second lubricant, at least a portion of the bore extends in a non-zero angle to the propeller shaft.

2. A propeller drive assembly according to claim 1, wherein the second lubrication system arranged to house the second lubricant in the form of a biodegradable oil.

3. A propeller drive assembly according to claim 1, wherein the second lubrication system presents a feeding cavity for the second lubricant, the second lubrication system being arranged to transport the second lubricant from the feeding cavity to the seal.

4. A propeller drive assembly according to claim 3, wherein the propeller drive assembly comprises a propeller shaft supporting a propeller at a first end of the propeller shaft, and in that the feeding cavity is located at a second end of the propeller shaft, which second end is opposite to the first end.

5. A propeller drive assembly according to claim 1, wherein the seal is provided between the propeller shaft and a further part of the propeller drive assembly, wherein the bore is arranged for the transport of the second lubricant towards the seal.

6. A propeller drive assembly according to claim 1, wherein the second lubrication system is arranged to transport the second lubricant to the seal at least partly by the force of gravity.

7. A propeller drive assembly according to claim 1, wherein the second lubrication system is arranged to transport the second lubricant to the seal at least partly by force of gravity, and comprises a storage reservoir arranged to communicate with the bore, and adapted to be located above the bore.

8. A propeller drive assembly according to claim 1, wherein the propeller drive assembly comprises a propeller shaft for supporting a propeller, wherein the second lubrication system presents a bore in the propeller shaft for the transport of the second lubricant, and that the second lubrication system comprises an Archimedes screw for urging the second lubricant through the bore.

9. A propeller drive assembly according to claim 8, wherein the Archimedes screw is located in the bore.

10. A propeller drive assembly according to claim 1, wherein die propeller drive assembly comprises a propeller shaft, and that the propeller drive assembly comprises at least one seal which surrounds the propeller shaft and is arranged to separate the first and second lubricants.

11. A propeller drive assembly according to claim 1, wherein the propeller drive assembly comprises a first propeller shaft for supporting a first propeller, and a second propeller shaft for supporting a second propeller, tire second propeller shaft being tubular and coaxial with the first propeller shaft, the first propeller shaft being arranged at least partly inside the second propeller shaft, and that the second lubrication system presents a gap (5024) between the first and second propeller shafts for the transport of the second lubricant.

12. A propeller drive assembly according to claim 1, wherein the propeller drive assembly comprises a propeller shaft, and a driveshaft extending in a non-zero angle to the propeller shaft and engaging with the propeller shaft via a bevelled gear set.

13. A propeller drive assembly according to claim 1, wherein the propeller drive assembly comprises a first propeller shaft for supporting a first propeller, and a second propeller shaft for supporting a second propeller, the second propeller shaft being tubular and coaxial with the first propeller shaft, the first propeller shaft being arranged at least partly inside the second propeller shaft, that the propeller drive assembly further comprises a driveshaft extending in a non-zero angle to the first aid second propeller shafts, and being arranged to drive the first and second propeller shafts, and that the second lubrication system presents a bore in the first propeller shaft for the transport of the second lubricant from a first side of tire driveshaft in a direction towards a second side of the driveshaft, opposite to the first side, the seal being located on the second side of the driveshaft.

14. A propeller drive assembly according to claim 13, wherein the second lubrication system presents a gap between the first and second propeller shafts for transport of the second lubricant received from said the bore, on the second side of the driveshaft.

15. A propeller drive assembly according to claim 13, wherein a first seal is arranged to separate the first and second lubricants, and is provided on the first side of the driveshaft, between the first propeller shaft and a surrounding fixed part of the propeller drive assembly.

16. A propeller drive assembly according to claim 13, wherein a second seal is arranged to separate the first and second lubricants, and is provided on the second side of the driveshaft, between the first and second propeller shafts.

17. A propeller drive assembly according to claim 13, wherein a third seal is arranged to separate the first and second lubricants, and is provided on the second side of the driveshaft, between the second propeller shaft and a surrounding fixed part of the propeller drive assembly.

18. A propeller drive assembly according to claim 13, wherein the seal arranged to seal the second lubrication system from the body of water, is provided between the first and second propeller shafts.

19. A propeller drive assembly according to claim 13, wherein the seal arranged to seal the second lubrication system from the body of water, is provided between the second propeller shaft and a surrounding fixed part of the propeller drive assembly.

20. A water surface vessel, comprising an assembly according to claim 1.

* * * * *